US011847878B2

(12) United States Patent
Morimoto

(10) Patent No.: US 11,847,878 B2
(45) Date of Patent: Dec. 19, 2023

(54) BANKNOTE HANDLING APPARATUS, BANKNOTE STORAGE METHOD, AND NON-TRANSITORY COMPUTER-READABLE RECORDING MEDIUM

(71) Applicant: FUJITSU FRONTECH LIMITED, Inagi (JP)

(72) Inventor: Yasuhiro Morimoto, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 17/825,708

(22) Filed: May 26, 2022

(65) Prior Publication Data

US 2022/0292906 A1 Sep. 15, 2022

Related U.S. Application Data

(63) Continuation of application No. PCT/JP2019/050645, filed on Dec. 24, 2019.

(51) Int. Cl.
*G07D 11/13* (2019.01)
*G07D 11/18* (2019.01)
*G07D 11/22* (2019.01)

(52) U.S. Cl.
CPC ..... *G07D 11/13* (2019.01); *G07D 11/18* (2019.01); *G07D 11/22* (2019.01)

(58) Field of Classification Search
CPC ..... G07D 11/13; G07D 11/18; G07D 11/22; G07D 11/16; G07D 11/20; G07D 11/12
See application file for complete search history.

(56) References Cited

U.S. PATENT DOCUMENTS

2005/0023341 A1 2/2005 Taniyama et al.
2011/0169210 A1 7/2011 Nagura et al.
(Continued)

FOREIGN PATENT DOCUMENTS

EP 2555170 A1 * 2/2013 ..... G07D 11/0006
JP 2005-49919 2/2005
(Continued)

OTHER PUBLICATIONS

JP2005085025A Sheet Processor and Method for Controlling Sheet Take-In Operation, 6 pages (Year: 2023).*
(Continued)

*Primary Examiner* — Tuyen K Vo
(74) *Attorney, Agent, or Firm* — STAAS & HALSEY LLP

(57) ABSTRACT

A banknote handling apparatus includes a distinguishing unit that distinguishes respective paper sheets input, a first storage mechanism that temporarily stores the respective paper sheets distinguished, a plurality of second storage mechanisms that are provided for each type of paper sheet and store the corresponding paper sheet, a determination unit that determines a conveyance order of conveying the respective paper sheets from the first storage mechanism to any of the second storage mechanisms on a basis of a result of distinguishing, and a drive control unit that controls activation and stop of respective drive apparatuses that, on a basis of the conveyance order, drive each of the plurality of second storage mechanisms to store the respective paper sheets in the corresponding second storage mechanism.

6 Claims, 13 Drawing Sheets

(56) References Cited

U.S. PATENT DOCUMENTS

| | | | | |
|---|---|---|---|---|
| 2012/0285787 | A1* | 11/2012 | Hosokawa | G07D 11/40 194/206 |
| 2018/0211468 | A1* | 7/2018 | Teshima | B65H 3/0653 |
| 2021/0158645 | A1* | 5/2021 | Wakabayashi | B65H 43/04 |

FOREIGN PATENT DOCUMENTS

| | | | | |
|---|---|---|---|---|
| JP | 2005-85025 | | 3/2005 | |
| JP | 2011113160 | A * | 6/2011 | G07D 11/40 |
| JP | 2011-145782 | | 7/2011 | |
| JP | 2012-68795 | | 4/2012 | |
| JP | 2013-50782 | | 3/2013 | |
| JP | 2014-222541 | | 11/2014 | |
| JP | 2014-241168 | | 12/2014 | |
| JP | 2018-14002 | | 1/2018 | |
| JP | 2019-21135 | | 2/2019 | |
| JP | 2019-101784 | | 6/2019 | |

OTHER PUBLICATIONS

JP2011113160A Bill Handling Apparatus, 10 pages (Year: 2023).*
JP2013050782A Bill Processing Device, Bill Processing Method, and Program, 9 pages (Year: 2023).*
Extended European Search Report, dated Dec. 9, 2022, in corresponding European Patent Application No. 19957251.2 (7 pp.).
International Search Report, dated Oct. 2, 2020, in International Patent Application No. PCT/JP2019/050645 (6 pp.).
Written Opinion of the International Searching Authority (4 pp.).

* cited by examiner

FIG.4

| APPARATUS | BANKNOTE | CASSETTE |
|---|---|---|
| AUTOMATIC CASH DEPOSIT/ PAYMENT APPARATUS X | 10,000 YEN BILL | CASSETTE A |
| | 5000 YEN BILL | CASSETTE B |
| | 1000 YEN BILL | CASSETTE C |
| | OTHER | CASSETTE D |
| AUTOMATIC CASH DEPOSIT/ PAYMENT APPARATUS Y | ... | ... |
| ... | ... | ... |

FIG.5

| ORDER | BANKNOTE TYPE |
|---|---|
| FIRST SHEET | 10,000 YEN BILL |
| SECOND SHEET | 10,000 YEN BILL |
| THIRD SHEET | 5000 YEN BILL |
| FOURTH SHEET | 5000 YEN BILL |
| FIFTH SHEET | 5000 YEN BILL |
| ... | ... |

FIG.6

| ORDER | BANKNOTE TYPE | STORAGE CASSETTE |
|---|---|---|
| FIRST SHEET | 10,000 YEN BILL | CASSETTE A |
| SECOND SHEET | 10,000 YEN BILL | CASSETTE A |
| THIRD SHEET | 5000 YEN BILL | CASSETTE B |
| FOURTH SHEET | 5000 YEN BILL | CASSETTE B |
| FIFTH SHEET | 5000 YEN BILL | CASSETTE B |
| ... | ... | ... |

(a) CONVEYANCE ORDER
FIRST SHEET
SEC-OND SHEET
THIRD SHEET
FOURTH SHEET
FIFTH SHEET
SIXTH SHEET
SEV-ENTH SHEET
EIGHTH SHEET
...
15TH SHEET
...
100TH SHEET
...
300TH SHEET
CAS-SETTE A
CAS-SETTE B
CAS-SETTE C
CAS-SETTE D
CASSETTE A NOT USED
CASSETTE B NOT USED
(b) MOTOR CONTROL
ACTI-VATE
STOP
ACTI-VATE
STOP
ACTI-VATE
STOP

BANKNOTE HANDLING APPARATUS, BANKNOTE STORAGE METHOD, AND NON-TRANSITORY COMPUTER-READABLE RECORDING MEDIUM

CROSS-REFERENCE TO RELATED APPLICATION

This application is a continuation application of International Application PCT/JP2019/050645, filed on Dec. 24, 2019, and designating the U.S., the entire contents of which are incorporated herein by reference.

FIELD

The present invention relates to a banknote handling apparatus, a banknote storage method, and a banknote storage program.

BACKGROUND

A banknote handling apparatus that handles banknotes such as an automated teller machine (ATM), a cash dispenser (CD), and a teller cash recycler (TCR) installed in a bank or the like, or a deposit/withdrawal machine installed in a back office or the like of a store is known. Such a banknote handling apparatus switches a conveyance destination such that the banknotes are contained in different cassettes for each denomination and state.

Such a banknote handling apparatus includes a deposit/withdrawal unit that deposits and withdraws paper sheets such as banknotes, a temporary storage that temporarily stores the deposited paper sheets, and a plurality of cassettes that serve as storage provided for each type of paper sheets. For example, the banknote handling apparatus executes distinguishing on the banknote deposited from the deposit/withdrawal unit, and stores the banknote in the temporary storage via a conveyance path. Subsequently, the banknote handling apparatus feeds the banknote from the temporary storage, activates a motor at a storage opening of the cassette corresponding to the banknote, and stores the banknote in an appropriate cassette.

Patent Literature 1: JP 2018-14002 A
Patent Literature 2: JP 2019-101784 A
Patent Literature 3: JP 2019-021135 A
Patent Literature 4: JP 2014-222541 A However, in the technique described above, since the motor of the cassette once rotated remains rotated until the banknote conveyance is completed, wasteful power is consumed. For example, when a banknote of 10,000 yen is first fed from the temporary storage, the banknote handling apparatus drives the motor of a cassette A for 10,000 yen to convey and store 10,000 yen in the cassette A. Then, the banknote handling apparatus continues to activate the motor of the cassette A until all the banknotes stored in the temporary storage are stored in each cassette. Therefore, even when there is no other 10,000 yen in the temporary storage after the first 10,000 yen, the motor of the cassette A corresponding to 10,000 yen continues to be activated, and thus wasteful power is consumed.

SUMMARY

According to an aspect of an embodiment, a banknote handling apparatus includes: a distinguishing unit that distinguishes respective paper sheets input; a first storage mechanism that temporarily stores the respective paper sheets distinguished; a plurality of second storage mechanisms that are provided for each type of paper sheet and store the corresponding paper sheet; a determination unit that determines a conveyance order of conveying the respective paper sheets from the first storage mechanism to any of the second storage mechanisms on a basis of a result of distinguishing; and a drive control unit that controls activation and stop of respective drive apparatuses that, on a basis of the conveyance order, drive each of the plurality of second storage mechanisms to store the respective paper sheets in the corresponding second storage mechanism.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 4 is a diagram illustrating an example of cassette information stored in a host server.

FIG. 5 is a diagram illustrating an example of storage information.

FIG. 6 is a diagram illustrating an example of secondary command information.

DESCRIPTION OF EMBODIMENTS

Hereinafter, examples of the banknote handling apparatus, the banknote storage method, and the banknote storage program according to the present invention will be described in detail with reference to the drawings. Note that this invention is not limited by the examples. In addition, the examples can be appropriately combined within a range without inconsistency.

First Example

Overall Configuration

Figure 1:
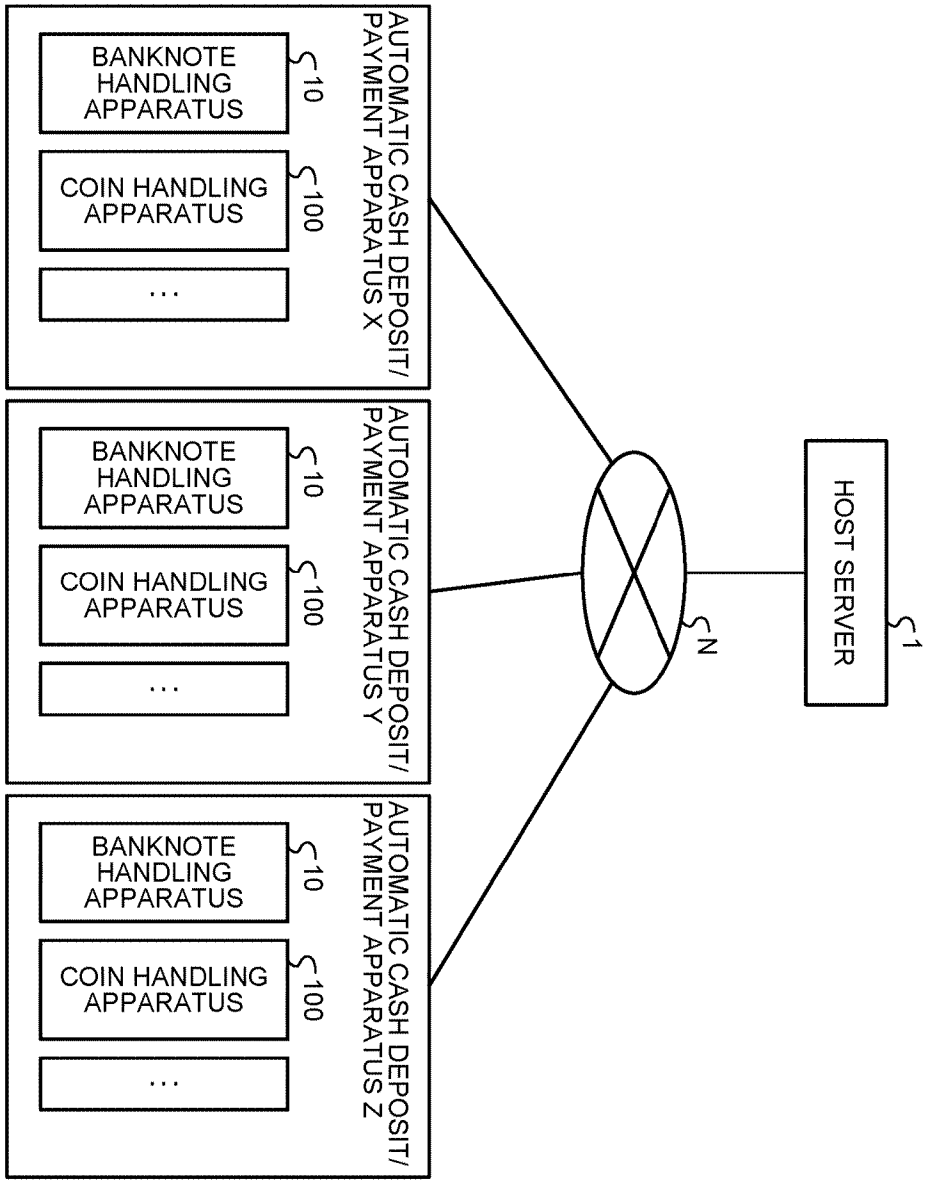
FIG. 1 is a diagram illustrating an overall configuration example of a system according to a first example.

FIG. 1 is a diagram illustrating an overall configuration example of a system according to the first example. As illustrated in FIG. 1, this system is a deposit/withdrawal system including a host server 1 and a plurality of automatic cash deposit/payment apparatuses including an automatic cash deposit/payment apparatus X, an automatic cash deposit/payment apparatus Y, and an automatic cash deposit/payment apparatus Z. Note that, in the first example, description will be made by taking Japanese yen as an example, but other banknotes such as dollar bills and paper sheets of voting ticket and securities such as stock certificates can be processed in a similar manner.

In addition, the host server and each automatic cash deposit/payment apparatus are communicably connected to each other via a network N. Note that various communication networks such as a dedicated line and the Internet can be adopted as the network N.

The host server 1 is an example of a server apparatus that manages deposit and withdrawal with respect to each automatic cash deposit/payment apparatus, and is, for example, a server apparatus installed in a host center of a financial institution such as a bank that owns and manages each automatic cash deposit/payment apparatus.

Each automatic cash deposit/payment apparatus includes a plurality of units such as a banknote handling apparatus 10 and a coin handling apparatus, and is an apparatus that processes deposit from a user and withdrawal to the user. The banknote handling apparatus 10 is an apparatus that stores a banknote deposited from the user in the cassette, which is an example of storage, and conveys and withdraws a banknote instructed to be withdrawn by the user from the cassette. A coin handling apparatus 100 is an apparatus that stores a coin deposited from the user in the cassette and conveys and withdraws a coin instructed to be withdrawn by the user from the cassette.

Description of the Banknote Handling Apparatus

Next, the banknote handling apparatus 10 will be described. Note that, although processing executed by the banknote handling apparatus 10 will be described here, similar processing can be applied to the coin handling apparatus 100.

Figure 2:
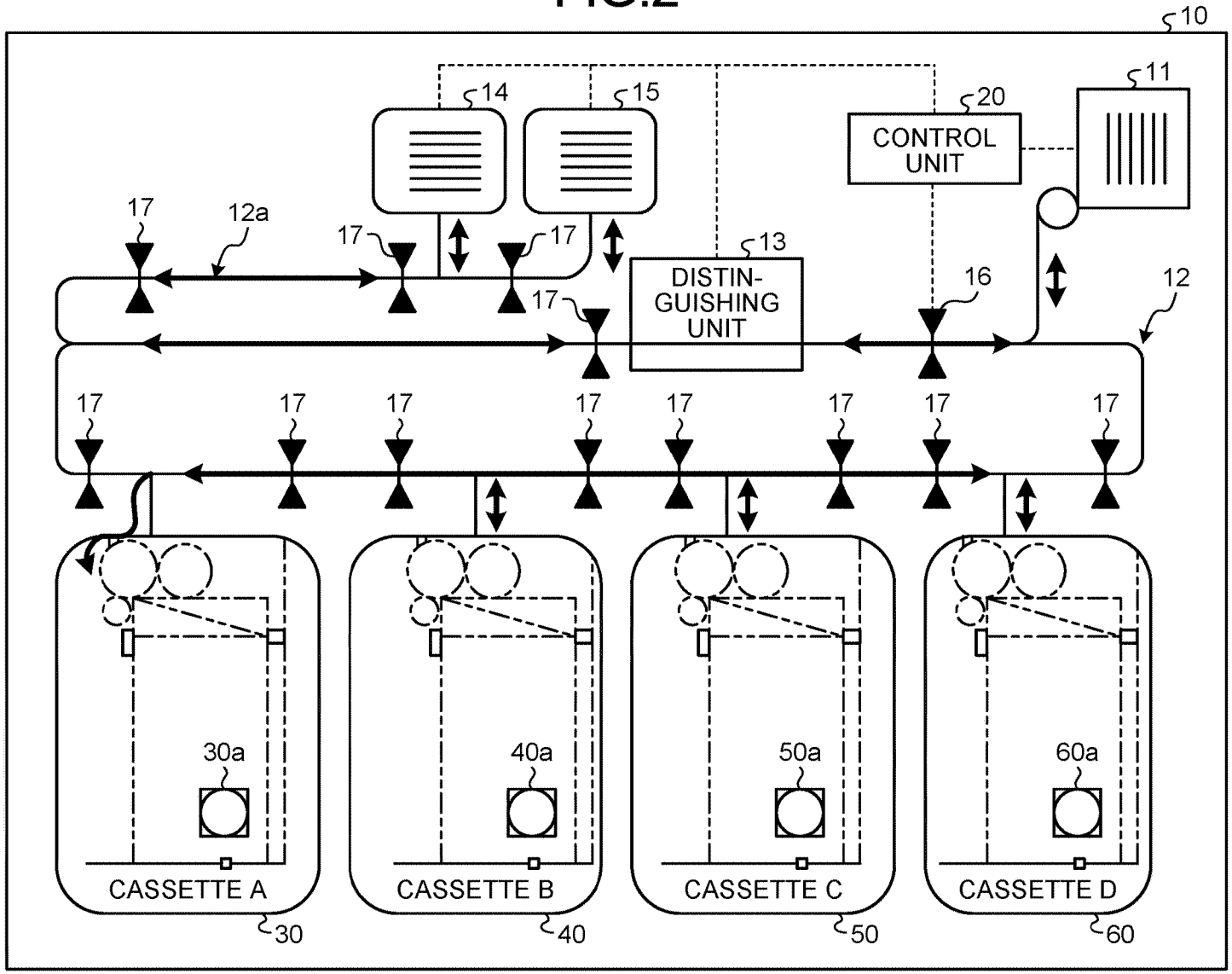
FIG. 2 is a diagram explaining a banknote handling apparatus according to the first example.

FIG. 2 is a diagram explaining the banknote handling apparatus 10 according to the first example. The banknote handling apparatus 10 includes a deposit/withdrawal unit 11, a conveying mechanism 12, a distinguishing unit 13, a temporary storage 14, a damaged banknote temporary storage 15, a reference sensor 16, passage sensors 17, a cassette A 30, a cassette B 40, a cassette C 50, a cassette D 60, and a control unit 20. Note that each unit described here is merely an example, and may include, for example, a functional unit such as a touch panel or another control mechanism in addition to these.

The deposit/withdrawal unit 11 is an input/output unit that processes the deposit/withdrawal of the banknote according to a banknote deposit/withdrawal transaction operation by the user. The conveying mechanism 12 is a driving unit that drives a roller, a motor, or the like, which is not illustrated, to convey the banknote in the banknote handling apparatus 10 via a conveyance path 12*a*. For example, the conveying mechanism 12 conveys the banknote deposited in the deposit/withdrawal unit 11 to the temporary storage 14 or the damaged banknote temporary storage 15, and conveys the banknote from the temporary storage 14 or the damaged banknote temporary storage 15 to each cassette.

The distinguishing unit 13 is a processing unit or a processing mechanism that executes various kinds of distinguishing such as the type of banknote, whether the banknote is genuine or counterfeit, and the degree of damage of the banknote. For example, the distinguishing unit 13 is installed on the conveyance path 12*a* between the deposit/withdrawal unit 11 and each of the temporary storages 14 and 15, and executes distinguishing of each deposited banknote. In addition, the distinguishing unit 13 can also execute distinguishing for each banknote conveyed from each of the temporary storages 14 and 15 to each cassette.

The temporary storage 14 is a storage that temporarily stores (holds) each deposited banknote before storage in the corresponding cassette. For example, the temporary storage 14 stores normal banknotes among the deposited banknotes in the order of distinguishing by the distinguishing unit 13. Note that the temporary storage 14 can store, for example, 300 sheets.

The damaged banknote temporary storage 15 is a storage that temporarily stores (holds) a damaged banknote that is not normal among the deposited banknotes before storage in the corresponding cassette. For example, the damaged banknote temporary storage 15 stores the banknote corresponding to the damaged banknote distinguished as a deteriorated banknote by the distinguishing unit 13 among the deposited banknotes in the order of distinguishing. Note that the damaged banknote temporary storage 15 can store, for example, 300 sheets.

The reference sensor 16 is a sensor for operating each motor that drives each cassette. For example, the reference sensor 16 is installed on the conveyance path 12*a* between the deposit/withdrawal unit 11 and the distinguishing unit 13 and between the distinguishing unit 13 and each cassette. In addition, when the reference sensor 16 detects the conveyance of the banknote via the conveyance path 12*a*, the reference sensor 16 outputs a detection signal to the control unit 20. Note that the position of the reference sensor 16 is an example, and is not limited thereto, and can be arranged at an arbitrary position depending on the positional relationship of main parts in the apparatus.

Each passage sensor 17 is a sensor that is installed on the conveyance path 12*a* and outputs a detection signal to the control unit 20 when detecting the conveyance of the banknote. For example, each passage sensor 17 is installed in the vicinity of the connection between each of the distinguishing unit 13, the temporary storage 14, the damaged banknote temporary storage 15, and the cassettes and the conveyance path 12*a* on the conveyance path 12*a* on which the banknote is conveyed. In this manner, it is possible to specify the conveyance status of the banknote and whether the banknote has been conveyed to the conveyance destination by the detection by each of the passage sensors 17.

The control unit 20 is a processing unit that manages the entire banknote handling apparatus 10, and is, for example, a processor such as a central processing unit (CPU) or an information processing apparatus including the processor. The control unit 20 determines the conveyance order of conveying each banknote stored in each temporary storage to any corresponding cassette on the basis of the result of distinguishing by the distinguishing unit 13. Then, the control unit 20 controls activation and stop of each motor that drives each cassette on the basis of the conveyance order, and stores each banknote in the corresponding cassette. Note that the control unit 20 is communicably connected to each unit illustrated in FIG. 2.

The cassette A 30 is a storage for storing a 10,000 yen bill (hereinafter, it may be simply described as "10,000 yen"), and includes a motor 30*a* for operating the cassette A 30. The cassette B 40 is a storage for storing a 5000 yen bill (hereinafter, it may be simply described as "5000 yen"), and includes a motor 40*a* for operating the cassette B 40.

The cassette C 50 is a storage for storing a 1000 yen bill (hereinafter, it may be simply described as "1000 yen"), and includes a motor 50*a* for operating the cassette C 50. The cassette D 60 is a rejecting storage for storing damaged banknotes, and includes a motor D60*a* for operating the cassette 60.

Functional Configuration

Figure 3:
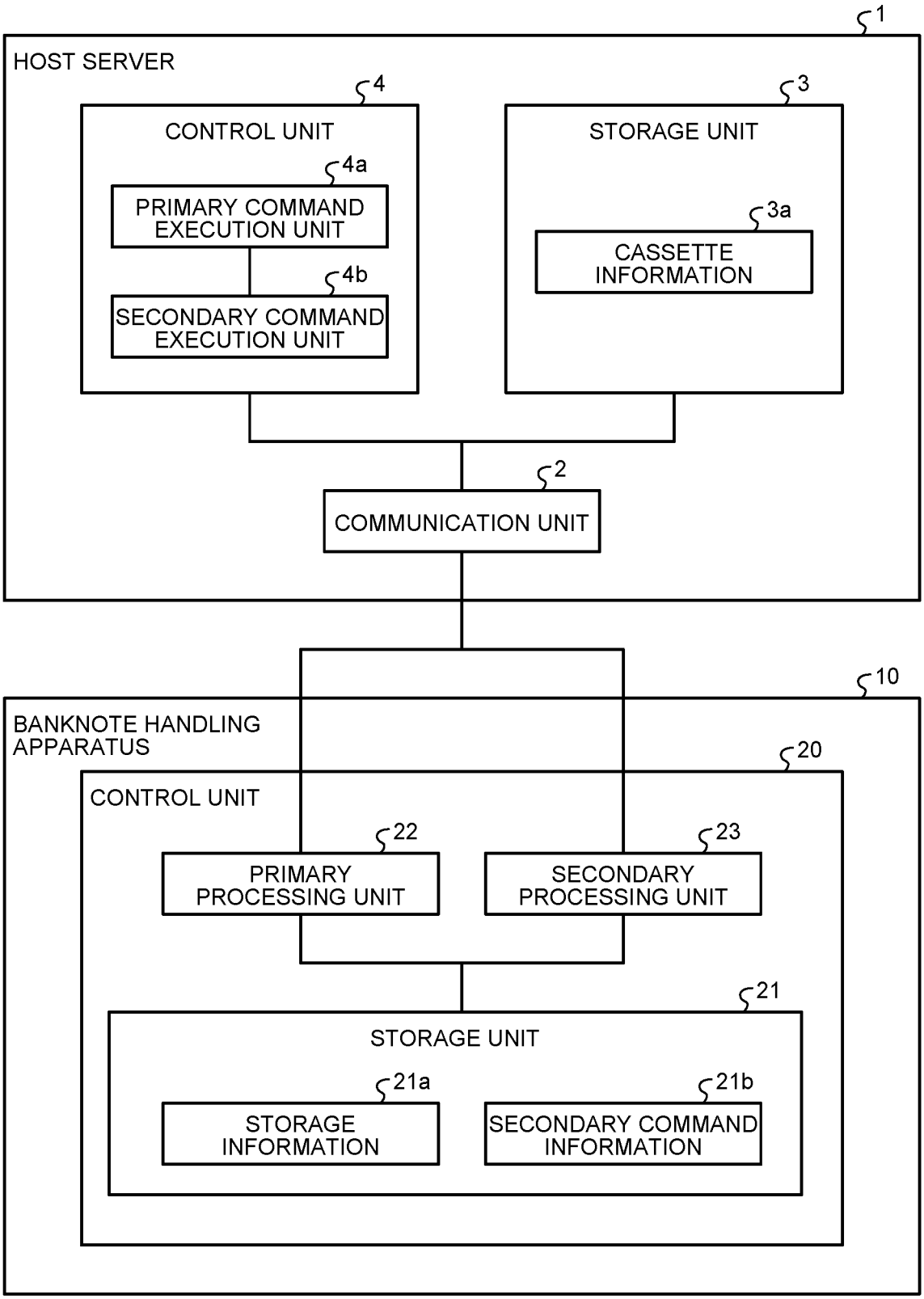
FIG. 3 is a functional block diagram illustrating a functional configuration of the system according to the first example.

Next, each of the functional configuration of the host server 1 and the functional configuration of the banknote handling apparatus 10 illustrated in FIG. 1 will be described with reference to FIG. 3. FIG. 3 is a functional block diagram illustrating a functional configuration of the system according to the first example.

(Functional Configuration of the Host Server 10)

As illustrated in FIG. 3, the host server 10 includes a communication unit 2, a storage unit 3, and a control unit 4. The communication unit 2 is a processing unit that controls communication with the banknote handling apparatus 10 of each cash deposit apparatus, and is, for example, a communication interface or the like. For example, the communication unit 2 receives various operations by the user, results of distinguishing, and the like from each banknote handling apparatus 10. In addition, the communication unit 2 transmits various commands and the like to each banknote handling apparatus 10.

The storage unit 3 is an example of a storage apparatus that stores various data, programs executed by the control unit 4, and the like, and is, for example, memory, a processor, or the like. The storage unit 3 stores cassette information 3*a*.

The cassette information 3*a* is information regarding the cassette of each banknote handling apparatus 10. Specifically, the cassette information 3*a* is the cassette included in each banknote handling apparatus 10, a storage target of each cassette, or the like. FIG. 4 is a diagram illustrating an example of the cassette information 3*a* stored in the host server 1. As illustrated in FIG. 4, the cassette information 3*a* is information in which "apparatus", "banknote", and "cassette" are associated.

The "apparatus" stored here is information for identifying each automatic cash deposit/payment apparatus. The "banknote" is information for specifying the type of banknote. The "cassette" is information for specifying a storage destination cassette. In the example of FIG. 4, it is defined that the banknote handling apparatus 10 of the automatic cash deposit/payment apparatus X includes the cassette A 30 for 10,000 yen bills, the cassette B 40 for 5000 yen bills, the cassette C 50 for 1000 yen bills, and a cassette D 60 for other banknotes.

The control unit 4 is a processing unit that controls the entire host server 1, and is, for example, a processor or the like. The control unit 4 includes a primary command execution unit 4*a* and a secondary command execution unit 4*b*. Note that the primary command execution unit 4*a* and the secondary command execution unit 4*b* are an example of an electronic circuit included in the processor and an example of a process executed by the processor.

The primary command execution unit 4*a* is a processing unit that issues a primary deposit command for instructing execution of distinguishing and the like of each deposited banknote. For example, when receiving a banknote deposit instruction from the banknote handling apparatus 10 of the automatic cash deposit/payment apparatus X, the primary command execution unit 4*a* opens the gate of the deposit/withdrawal unit 11 to accept the deposit. Then, when the deposit of the banknote is detected through the banknote handling apparatus 10 of the automatic cash deposit/payment apparatus X, the primary command execution unit 4*a* closes the gate of the deposit/withdrawal unit 11 and issues a primary deposit command to the control unit 20 of the banknote handling apparatus 10. By this primary deposit command, distinguishing of each deposited banknote and conveyance to each temporary storage are executed.

The secondary command execution unit 4*b* is a processing unit that issues a secondary deposit command for instructing execution of storage and the like of each deposited banknote. Specifically, when receiving the storage information based on the result of distinguishing from the banknote handling apparatus 10 of the automatic cash deposit/payment apparatus X, the secondary command execution unit 4*b* generates secondary command information to which information for specifying the storage destination cassette for each banknote included in the storage information is added. Then, the secondary command execution unit 4*b* issues a secondary deposit command including the secondary command information to the control unit 20 of the banknote handling apparatus 10 to store each banknote in the cassette. Note that details of the secondary command information will be described below.

(Functional Configuration of the Control Unit 20 of the Banknote Handling Apparatus 10)

As illustrated in FIG. 3, the control unit 20 of the banknote handling apparatus 10 includes a storage unit 21, a primary processing unit 22, and a secondary processing unit 23. In addition, the primary processing unit 22 and the secondary processing unit 23 are an example of an electronic circuit included in the processor and an example of a process executed by the processor. Note that, in FIG. 3, only the control unit 20 included in the banknote handling apparatus 10 is illustrated in order to simplify the description.

In addition, the control unit 20 executes communication with other functional units included in the banknote handling apparatus 10 and the host server 1. For example, the control unit 20 receives a detection signal from the reference sensor 16 or the passage sensor of the banknote handling apparatus 10, receives the result of distinguishing from the distinguishing unit 13 of the banknote handling apparatus 10, and receives the result of storage from each cassette. In addition, the control unit 20 transmits the result of distinguishing to the host server 1 and receives the primary deposit command and the secondary deposit command from the host server 1.

The storage unit 21 is an example of a storage apparatus such as internal memory included in the processor, and stores storage information 21*a* and secondary command information 21*b*.

The storage information 21*a* is information generated by the primary processing unit 22 to be described below, and is information regarding banknotes stored in each temporary storage. FIG. 5 is a diagram illustrating an example of the storage information 21*a*. As illustrated in FIG. 5, the storage information 21*a* is information in which "order" and "banknote type" are associated. The "order" is the reverse order of the storage order, and the "banknote type" is the type of distinguished banknote. The example of FIG. 5 illustrates that the "first sheet" that is stored last and is first conveyed to the cassette is a "10,000 yen bill". Note that the storage information 21*a* is generated for each temporary storage.

The secondary command information 21*b* is information received from the host server 1 by the secondary processing unit 23 to be described below, and is information regarding the conveyance order of the banknote stored in each temporary storage. FIG. 6 is a diagram illustrating an example of the secondary command information 21*b*. As illustrated in FIG. 6, the secondary command information 21*b* is information in which "order", "banknote type", and "storage cassette" are associated. The "order" is the order of conveyance, the "banknote type" is the type of the distinguished banknote, and the "storage cassette" is information for specifying the conveyance destination cassette. The example of FIG. 6 illustrates that "first sheet" to be conveyed first is a "10,000 yen bill", and the storage destination is the "cassette A 30". Note that the secondary command information 21*b* is generated for each temporary storage.

The primary processing unit 22 is a processing unit that executes the primary deposit command received from the host server 1 and executes the distinguishing and the primary storage of each deposited banknote. For example, when receiving the primary deposit command from the host server 1, the primary processing unit 22 executes the primary deposit command. By executing the primary deposit command, the primary processing unit 22 inputs the banknotes deposited in the deposit/withdrawal unit 11 one by one into the conveyance path 12*a*, and causes the distinguishing unit 13 to execute distinguishing. Then, on the basis of the result of distinguishing by the distinguishing unit 13, the primary processing unit 22 stores a normal banknote in the temporary storage 14, and stores an abnormal banknote (damaged banknote) in the damaged banknote temporary storage 15.

In addition, the primary processing unit 22 receives detection signals from the passage sensors 17 installed at the entrances of the distinguishing unit 13 and the temporary storages, thereby specifying the order of the conveyed banknotes and the status of the primary storage. Then, the primary processing unit 22 acquires the result of distinguishing for each deposited banknote from the distinguishing unit 13 and generates the storage information 21*a*. For example, the primary processing unit 22 associates the order of distinguishing with the type of the banknote specified by distinguishing. Then, the primary processing unit 22 generates the storage information 21*a* in which sorting is performed in the reverse order of the distinguishing order and the order is rearranged. That is, the primary processing unit 22 performs rearrangement such that the first distinguished banknote becomes the last and the last distinguished banknote becomes the first. Then, when the distinguishing and the primary storage of each deposited banknote are completed, the primary processing unit 22 transmits the storage information 21*a* to the host server 1.

Here, the secondary command execution unit 4*b* of the host server 1 generates the secondary command information on the basis of the storage information 21*a* received from the banknote handling apparatus 10, and transmits the secondary command information to the banknote handling apparatus 10 as the secondary deposit command. Specifically, when receiving the storage information 21*a* illustrated in FIG. 5, the secondary command execution unit 4*b* associates the storage cassettes with each order according to the cassette information illustrated in FIG. 4. For example, the secondary command execution unit 4*b* associates "cassette A" with the first sheet since the first sheet is a 10,000 yen bill, and associates "cassette A" with the second sheet since the second sheet is also a 10,000 yen bill. In this manner, the secondary command execution unit 4*b* generates the secondary command information illustrated in FIG. 6 and transmits the secondary command information to the control unit 20.

Returning to the description of the control unit 20, the secondary processing unit 23 is a processing unit that executes the secondary deposit command received from the host server 1 and stores each primarily stored banknote to the corresponding cassette. Specifically, the secondary processing unit 23 determines the conveyance order of each banknote according to the secondary command information included in the secondary deposit command received from the host server 1. Then, the secondary processing unit 23 sets parameters of the secondary deposit command according to the conveyance order, controls the activation and stop of each motor of each cassette, and conveys and stores each banknote from each temporary storage to the corresponding cassette.

For example, when receiving the secondary command information 21*b* illustrated in FIG. 6, the secondary processing unit 23 determines the "order" of the secondary command information 21*b* in the order of conveyance. In the case of FIG. 6, the secondary processing unit 23 inputs a "10,000 yen bill" corresponding to the order "first sheet" from the temporary storage 14 to the conveyance path 12*a* and conveys the 10,000 yen bill, and when detecting that the "10,000 yen bill" has passed through the reference sensor 16, activates the motor 30*a* of the storage cassette "cassette A 30" to operate the cassette A 30.

Then, when receiving a storage completion signal of the "10,000 yen bill" from the cassette A 30 or a detection signal from the passage sensor 17 installed immediately before the cassette A 30 on the conveyance path 12*a*, the secondary processing unit 23 inputs a "10,000 yen bill" corresponding to the order "second sheet" from the temporary storage 14 to the conveyance path 12*a* and conveys the 10,000 yen bill. Here, since the storage cassette "cassette A 30" is already in operation, the secondary processing unit 23 does not execute the control of the motor 30*a*.

Then, when receiving a storage completion signal of the second "10,000 yen bill" sheet from the cassette A 30 or a detection signal from the passage sensor 17 installed immediately before the cassette A 30 on the conveyance path 12*a*, the secondary processing unit 23 inputs a "5000 yen bill" corresponding to the order "third sheet" from the temporary storage 14 to the conveyance path 12*a* and conveys the 5000 yen bill. Then, when detecting that the "5000 yen bill" has passed through the reference sensor 16, the secondary processing unit 23 activates the motor 40*a* of the storage cassette "cassette B 40" and operates the cassette B 40.

In this manner, the secondary processing unit 23 activates the motor of each cassette according to the order of conveyance, and conveys and stores each banknote to each cassette. Here, according to the secondary command information 21*b*, the secondary processing unit 23 determines whether or not each cassette that has started operation is used as a conveyance destination even after the start of operation. Then, the secondary processing unit 23 stops the motor of the cassette determined not to be used. That is, the secondary processing unit 23 stops the operation of a cassette that is not used thereafter among the cassettes that have started the operation.

Figure 7:
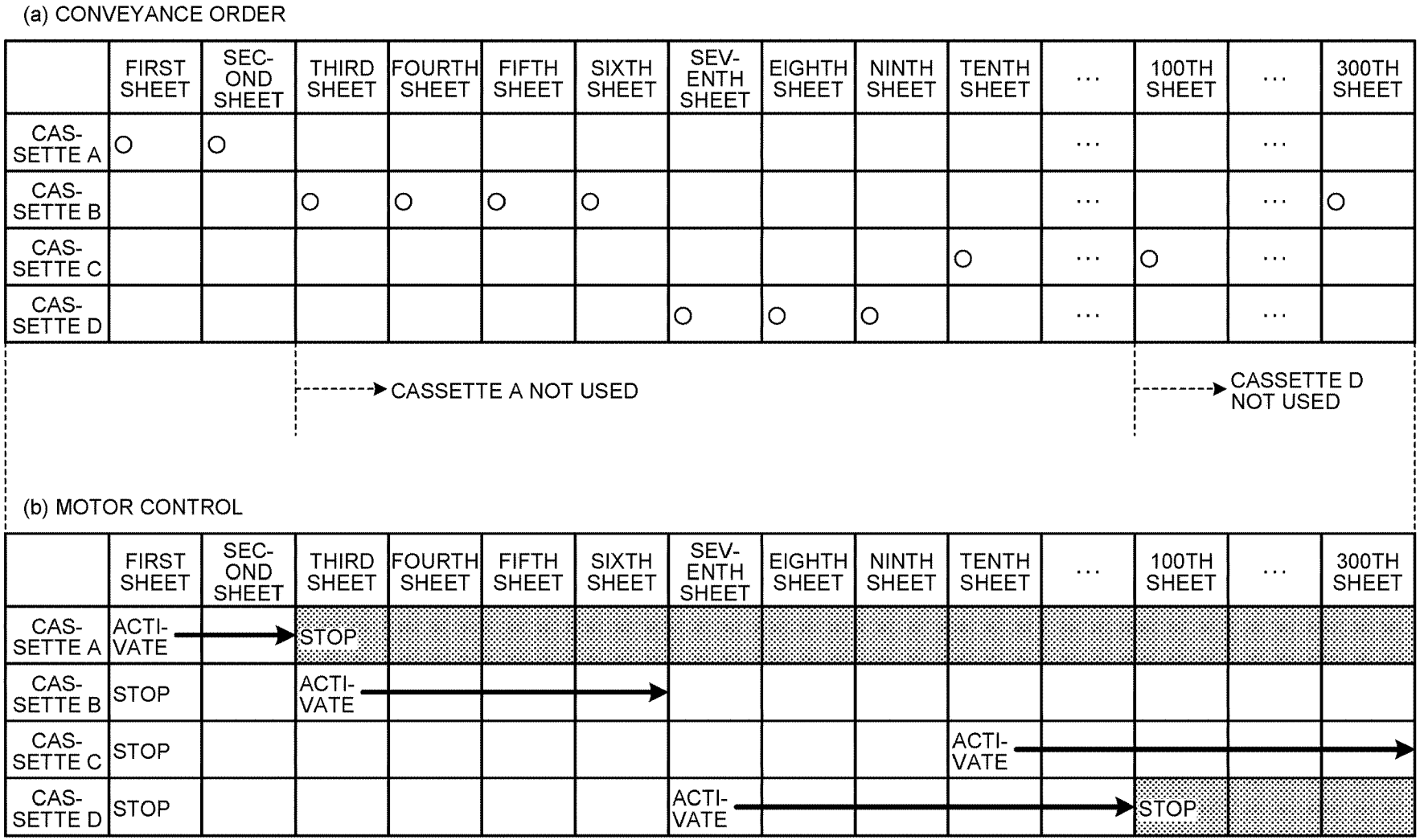
FIG. 7 is a diagram explaining motor control of each cassette.

FIG. 7 is a diagram explaining motor control of each cassette. (a) of FIG. 7 illustrates the order of the banknote conveyance destinations, and (b) of FIG. 7 illustrates motor control of each cassette. Here, as illustrated in (a) of FIG. 7, the cassette A 30 is used for the first sheet, then again used for the second sheet, but is not used for the third and subsequent sheets. After the cassette B 40 is used for the third sheet, the cassette B 40 is appropriately used up to the 300th sheet. After the cassette C 50 is used for the tenth sheet, the cassette C 50 is appropriately used up to the 300th sheet. After the cassette D 60 is used for the seventh sheet, the cassette D 60 is appropriately used up to the 100th sheet, but is not used thereafter.

In this case, as illustrated in (b) of FIG. 7, the secondary processing unit 23 activates the motor 30*a* of the cassette A at the time of conveyance of the first sheet, and then stops the motor 30*a* when the storage of the second sheet is completed. In addition, the secondary processing unit 23 activates the motor 40*a* of the cassette B 40 at the time of conveyance of the third sheet, then activates the motor 40*a* up to the end, and stops the motor 40*a* when the storage of the 300th sheet is completed. In addition, the secondary processing unit 23 activates the motor 50*a* of the cassette C 50 at the time of conveyance of the tenth sheet, then activates the motor 50*a* up to the end, and stops the motor 50*a* when the storage of the 300th sheet is completed. In addition, the secondary processing unit 23 activates the motor 60*a* of the cassette D 60 at the time of conveyance of the seventh sheet, and then stops the motor 60*a* when the storage of the 100th sheet is completed.

As described above, the secondary processing unit 23 specifies the timing at which the cassette is no longer used in one time deposit processing and appropriately stops the operation of the unused cassette, thereby suppressing wasteful operation of the cassette and suppressing unnecessary power consumption.

Flow of Processing

Next, the processing executed by the above-described banknote handling apparatus 10 will be described. Here, a sequence diagram illustrating an overall flow, the primary deposit processing, and the secondary deposit processing will be described.

(Sequence Diagram)

Figure 8:
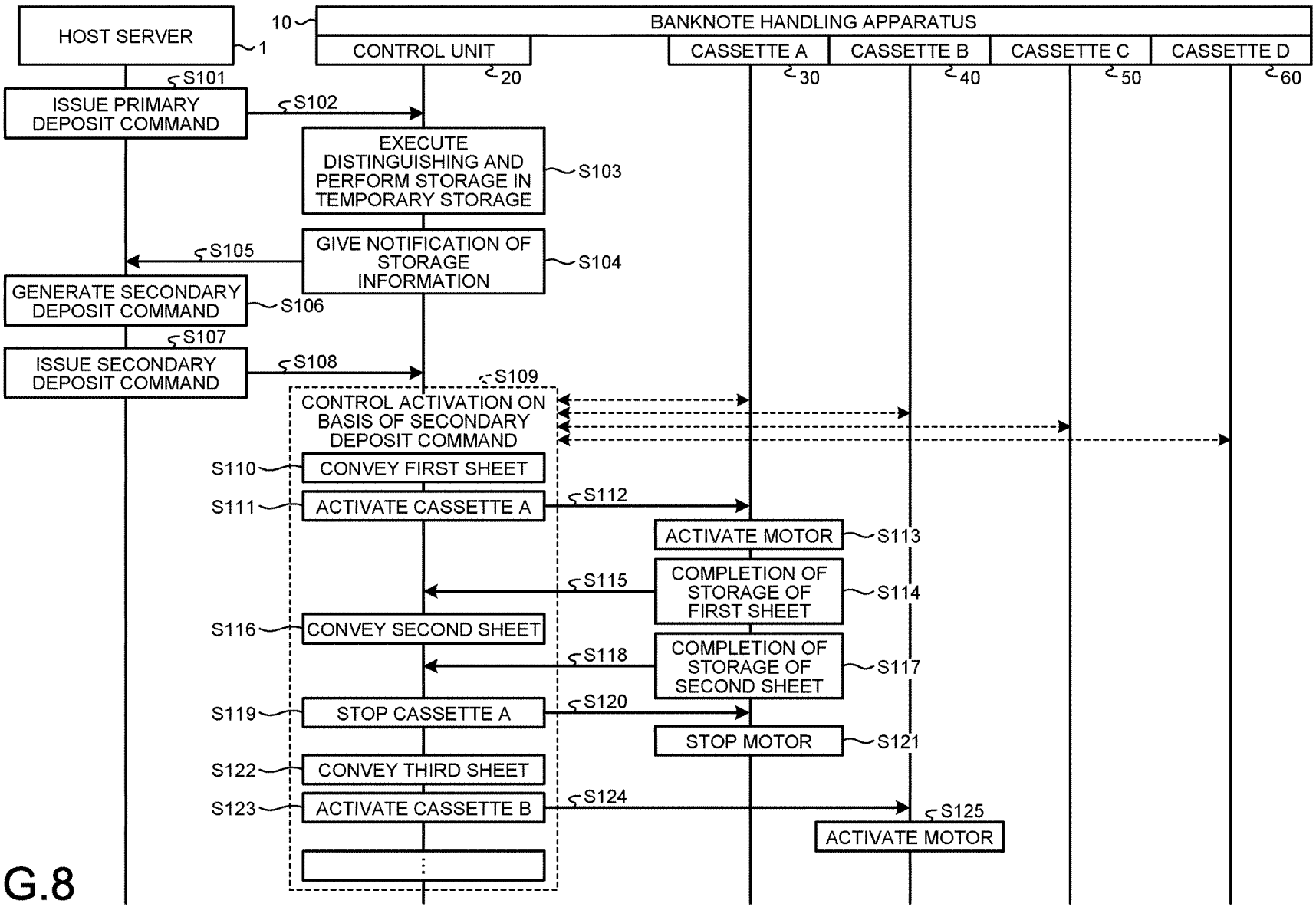
FIG. 8 is a sequence diagram illustrating a flow of processing according to the first example.

FIG. 8 is a sequence diagram illustrating a flow of processing according to the first example. As illustrated in FIG. 8, when receiving the user's deposit operation from the banknote handling apparatus 10, the primary command execution unit 4*a* of the host server 1 issues the primary deposit command to the banknote handling apparatus 10 (S101 and S102).

Subsequently, the primary processing unit 22 of the control unit 20 of the banknote handling apparatus 10 executes the received primary deposit command. That is, the primary processing unit 22 executes distinguishing of each deposited banknote and stores the banknote in each temporary storage (S103), generates the storage information 21*a* from the result of distinguishing, and transmits the storage information 21*a* to the host server 1 (S104 and S105).

Then, the secondary command execution unit 4*b* of the host server 1 generates secondary command information on the basis of the received storage information 21*a* and the cassette information 3*a* (S106). Subsequently, the secondary command execution unit 4*b* issues a secondary deposit command including the secondary command information to the banknote handling apparatus 10 (S107 and S108).

Then, the secondary processing unit 23 of the control unit 20 of the banknote handling apparatus 10 executes the received secondary deposit command, and controls the motor of each cassette on the basis of the secondary command information included in the secondary deposit command (S109).

For example, the secondary command information 21*b* illustrated in FIG. 6 will be described as an example, and the secondary processing unit 23 conveys the banknote (10,000 yen bill) of the first sheet from the temporary storage 14 to the cassette A 30 (S110) according to the secondary command information 21*b*, and when the banknote passes through the reference sensor 16, activates the cassette A 30, which is the storage destination of the first sheet (S111 and S112). As a result, the motor 30*a* of the cassette A 30 starts driving (S113).

Then, when receiving a first sheet storage completion notification from the cassette A 30 (S114 and S115), the secondary processing unit 23 conveys the banknote (10,000 yen bill) of the second sheet from the temporary storage 14 to the cassette A 30 (S116).

Then, when receiving a second sheet storage completion notification from the cassette A 30 (S117 and S118), the secondary processing unit 23 stops the cassette A 30 that is not scheduled to be used thereafter (S119 and S120). As a result, the motor 30*a* of the cassette A 30 ends driving (S121).

Subsequently, the secondary processing unit 23 conveys the banknote (5000 yen bill) of the third sheet from the temporary storage 14 to the cassette B 40 (S122), and when the banknote passes through the reference sensor 16, activates the cassette B 40, which is the storage destination of the third sheet (S123 and S124). As a result, the motor 40*a* of the cassette B 40 starts driving (S125). Thereafter, driving and stop of the motor of each cassette are executed according to the secondary command information 21*b*, and the operation of each cassette is controlled.

(Flow of the Primary Deposit Processing)

Figure 9:
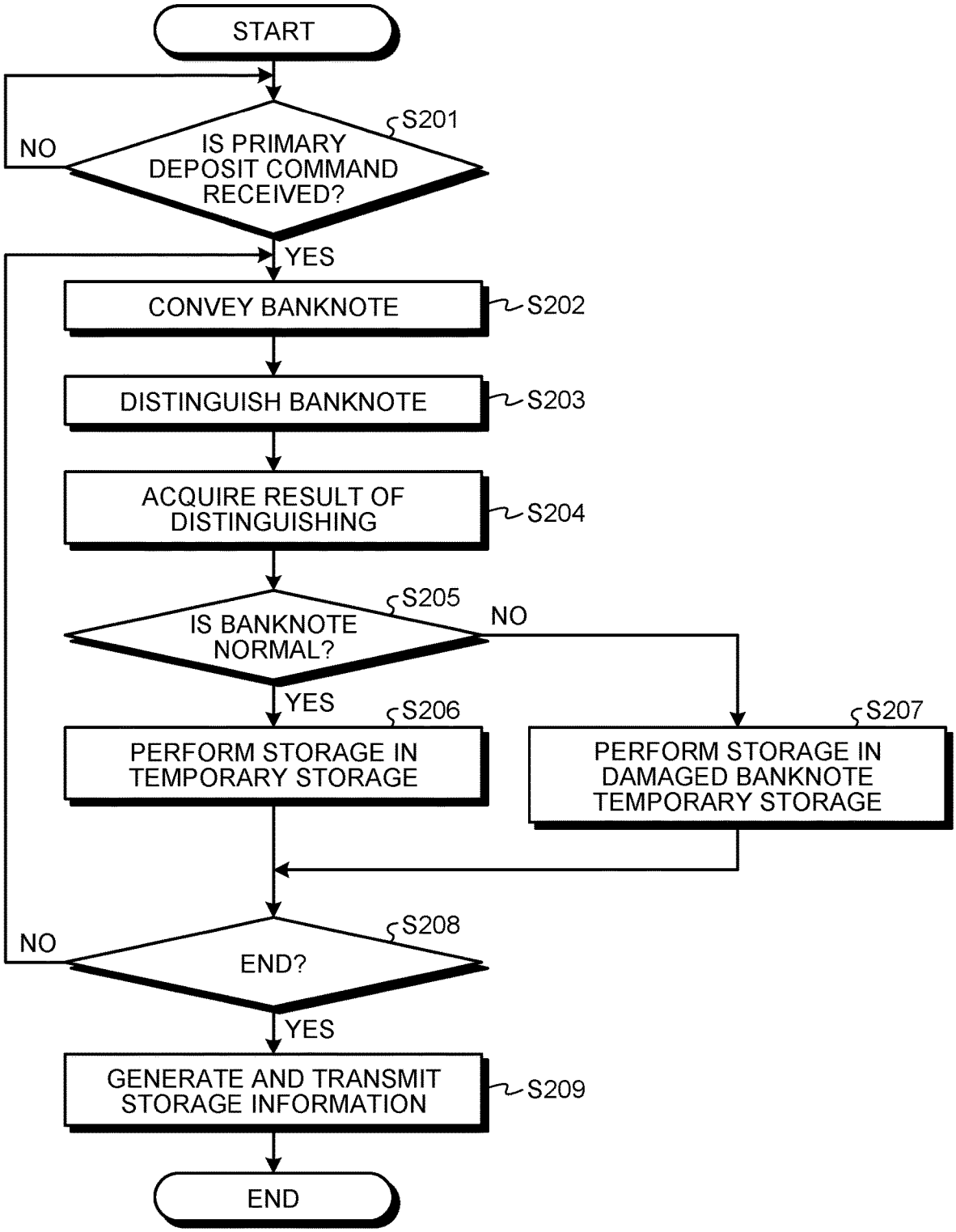
FIG. 9 is a flowchart illustrating a flow of primary deposit processing of the banknote handling apparatus according to the first example.

FIG. 9 is a flowchart illustrating a flow of the primary deposit processing of the banknote handling apparatus 10 according to the first example. As illustrated in FIG. 9, when receiving the primary deposit command from the host server 1 (S201: Yes), the primary processing unit 22 of the control unit 20 of the banknote handling apparatus 10 conveys one sheet of deposited banknote to each temporary storage (S202).

Then, the primary processing unit 22 executes distinguishing of each banknote by the distinguishing unit 13 present on the conveyance pathway (S203), and acquires the result of distinguishing from the distinguishing unit 13 (S204). Here, in a case where it is distinguished that the state of the banknote is normal (S205: Yes), the primary processing unit 22 conveys the banknote to the temporary storage 14 (S206), and in a case where it is distinguished that the state of the banknote is not normal (S205: No), the primary processing unit 22 conveys the banknote to the damaged banknote temporary storage 15 (S207).

Then, when there is an unconveyed banknote among the deposited banknotes (S208: No), the primary processing unit 22 executes S202 and the subsequent steps for the next banknote. On the other hand, when the conveyance of each deposited banknote to each temporary storage ends (S208: Yes), the primary processing unit 22 generates the storage information 21*a* for each temporary storage and transmits the storage information 21*a* to the host server 1 (S209).

(Flow of the Secondary Deposit Processing)

Figure 10:
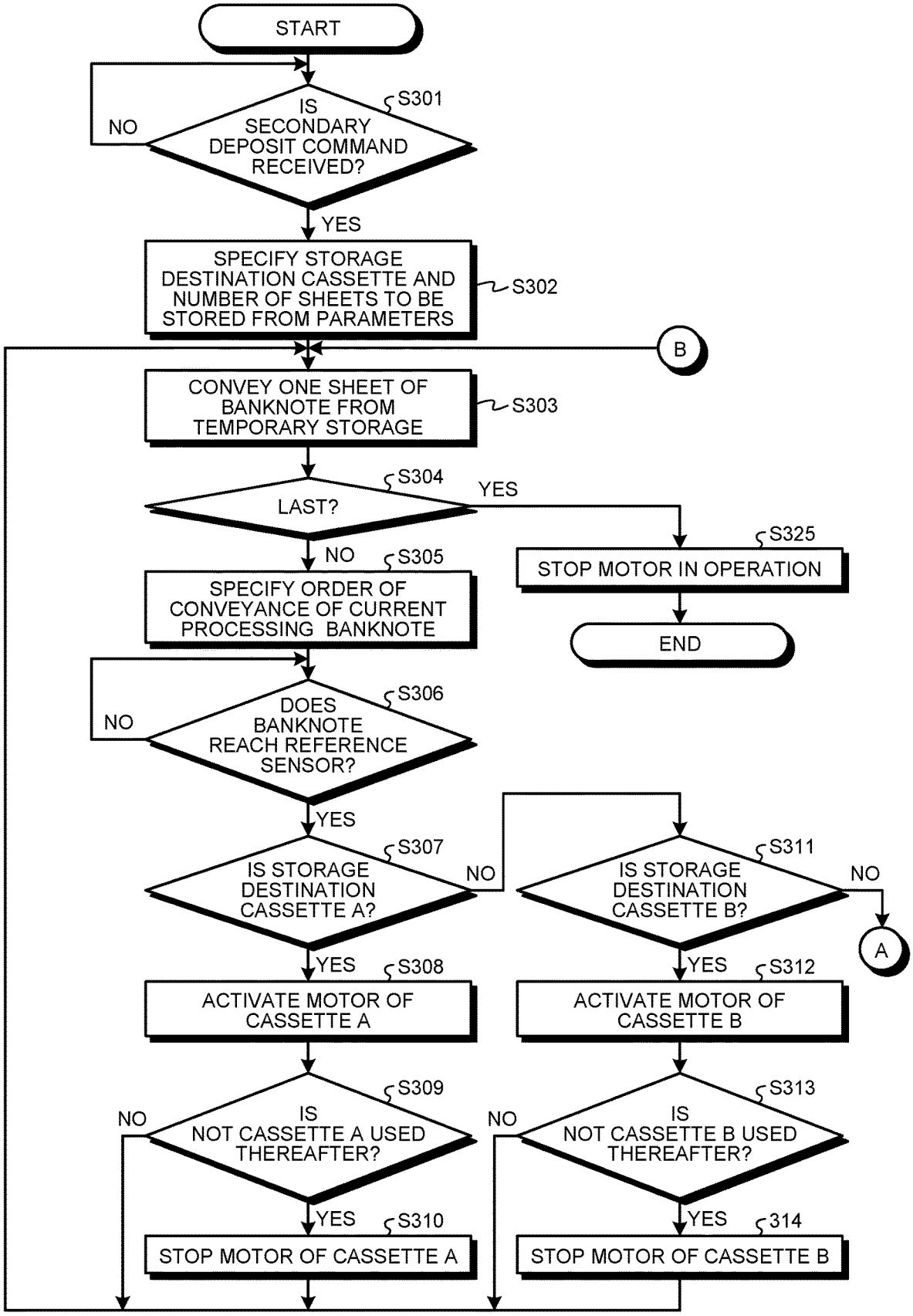
FIG. 10 is a flowchart illustrating a flow of secondary deposit processing of the banknote handling apparatus according to the first example.
Figure 11:
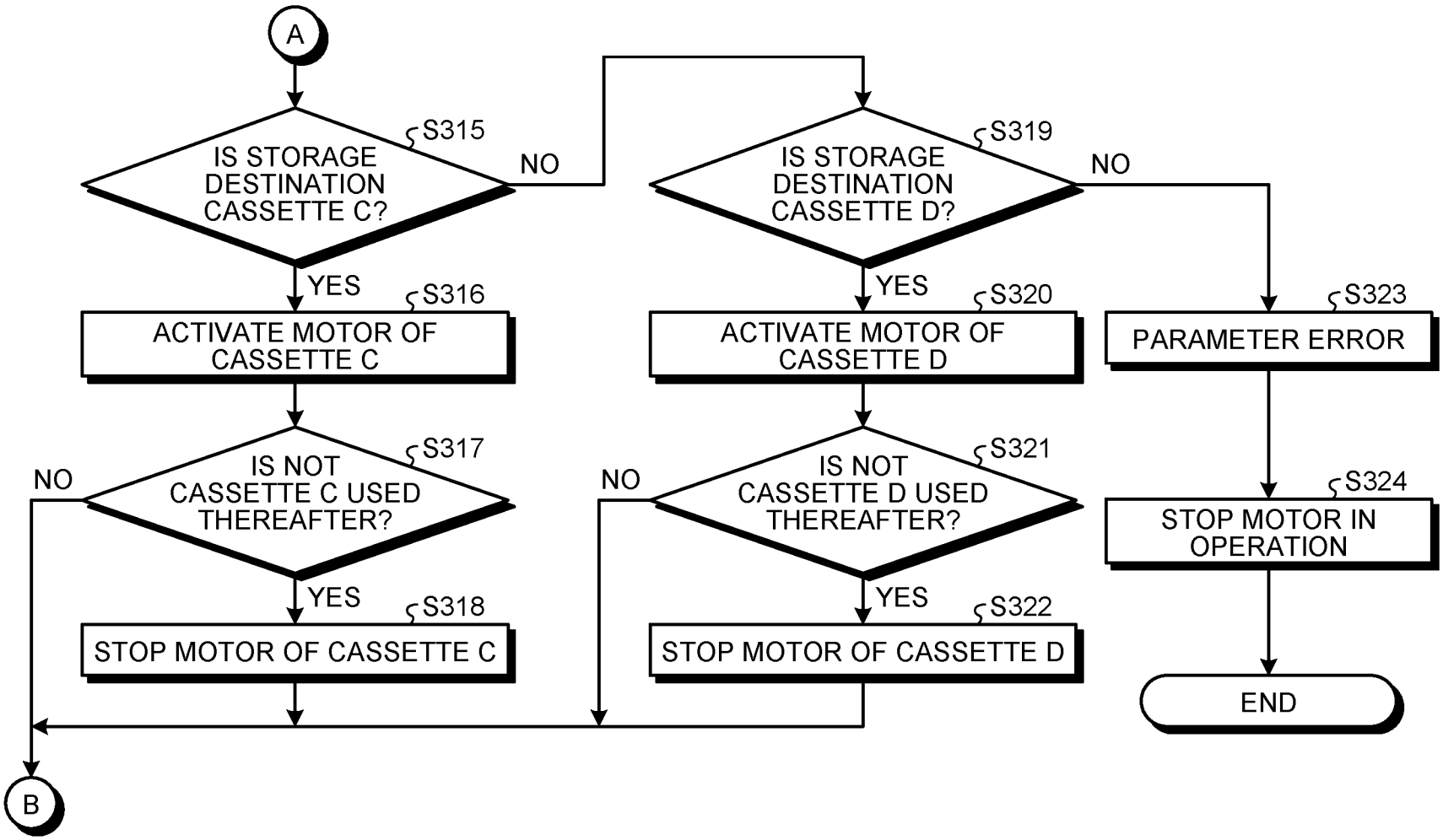
FIG. 11 is a flowchart illustrating a flow of secondary deposit processing of the banknote handling apparatus according to the first example.

FIGS. 10 and 11 are flowcharts illustrating a flow of the secondary deposit processing of the banknote handling apparatus 10 according to the first example. As illustrated in FIG. 10, when receiving the secondary deposit command from the host server 1 (S301: Yes), the secondary processing unit 23 of the control unit 20 of the banknote handling apparatus 10 specifies the number of sheets to be stored and the storage destination cassette from the secondary command information 21*b* (parameter) of the secondary deposit command, and determines the conveyance order of each banknote (S302).

Then, the secondary processing unit 23 starts the conveyance of one sheet of banknote from the temporary storage 14 according to the conveyance order (S303), and when the number of storages (the number of deposited sheets) is not reached by the banknote to be conveyed, that is, when there is a banknote to be conveyed (S304: No), specifies the order of conveyance of the current processing banknote according to the conveyance order (S305).

Then, the secondary processing unit 23 stands by until the banknote reaches the reference sensor 16 (S306: No), and when the banknote reaches the reference sensor 16 (S306: Yes), the secondary processing unit 23 determines whether or not the storage destination is the cassette A 30 (S307).

Here, when the storage destination is the cassette A 30 (S307: Yes), the secondary processing unit 23 activates the motor 30*a* of the cassette A 30 (S308). Note that when the motor 30*a* is already activated (in operation), the processing of S308 is omitted.

Then, when the cassette A 30 is not used as the storage destination thereafter (S309: Yes) according to the secondary command information 21*b*, the secondary processing unit 23 stops the motor 30*a* of the cassette A 30 (S310), and then executes S303 and the subsequent steps on the banknote in the next order of conveyance. On the other hand, when the cassette A 30 is subsequently used as the storage destination (S309: No), the secondary processing unit 23 maintains the driving of the motor 30*a* of the cassette A 30 and executes S303 and the subsequent steps on the banknote in the next order of conveyance.

In addition, when the storage destination is not the cassette A 30 (S307: No), but the cassette B 40 (S311: Yes), the secondary processing unit 23 activates the motor 40*a* of the cassette B 40 (S312). Note that when the motor 40*a* is already activated (in operation), the processing of S312 is omitted.

Then, when the cassette B 40 is not used as the storage destination thereafter (S313: Yes) according to the secondary command information 21*b*, the secondary processing unit 23 stops the motor 40*a* of the cassette B 40 (S314), and then executes S303 and the subsequent steps on the banknote in the next order of conveyance. On the other hand, when the cassette B 40 is subsequently used as the storage destination (S313: No), the secondary processing unit 23 maintains the driving of the motor 40*a* of the cassette B 40 and executes S303 and the subsequent steps on the banknote in the next order of conveyance.

In addition, as illustrated in FIG. 11, when the storage destination is not the cassette B 40 (S311: No), but the cassette C 50 (S315: Yes), the secondary processing unit 23 activates the motor 50*a* of the cassette C 50 (S316). Note that when the motor 50*a* is already activated (in operation), the processing of S316 is omitted.

Then, when the cassette C 50 is not used as the storage destination thereafter (S317: Yes) according to the secondary command information 21*b*, the secondary processing unit 23 stops the motor 50*a* of the cassette C 50 (S318), and then executes S303 and the subsequent steps on the banknote in the next order of conveyance. On the other hand, when the cassette C 50 is subsequently used as the storage destination (S317: No), the secondary processing unit 23 maintains the driving of the motor 50*a* of the cassette C 50 and executes S303 and the subsequent steps on the banknote in the next order of conveyance.

In addition, when the storage destination is not the cassette C 50 (S315: No), but the cassette D 60 (S319: Yes), the secondary processing unit 23 activates the motor 60*a* of the cassette D 60 (S320). Note that when the motor 60*a* is already activated (in operation), the processing of S320 is omitted.

Then, when the cassette D 60 is not used as the storage destination thereafter (S321: Yes) according to the secondary command information 21*b*, the secondary processing unit 23 stops the motor 60*a* of the cassette D 60 (S322), and then executes S303 and the subsequent steps on the banknote in the next order of conveyance. On the other hand, when the cassette D 60 is subsequently used as the storage destination (S321: No), the secondary processing unit 23 maintains the driving of the motor 60*a* of the cassette D 60 and executes S303 and the subsequent steps on the banknote in the next order of conveyance.

On the other hand, when the storage destination is not the cassette D 60 (S319: No), all the cassettes do not correspond to the storage destination, and thus the secondary processing unit 23 determines that there is a parameter error (S323), stops all the motors in operation (S324), and ends the secondary deposit processing.

Note that, in S304 of FIG. 10, when the number of storages (the number of deposited sheets) is reached by the banknote to be conveyed, that is, when there is no banknote to be conveyed (S304: Yes), the secondary processing unit 23 stops all the motors in operation (S325), and ends the secondary deposit processing.

Effects

In a general technique, when the banknotes stored in the deposit primary command are stored in each cassette, up to 300 sheets of banknotes are stored in each cassette, but even when only one sheet is stored, the cassette is kept rotated until all the deposited banknotes are completely stored, and thus wasteful power is consumed. On the other hand, since the banknote handling apparatus 10 according to the first example can specify the storage destination of the cassette in the storage order by the secondary deposit command as described above, the motors of the cassettes that are not used can be stopped at the timing when it is determined that there is no storage thereafter. Therefore, the banknote handling apparatus 10 according to the first example can suppress wasteful power consumption.

Second Example

By the way, in the first example, the example of stopping the operation of the cassette that is not used thereafter has been described, but it is not limited thereto, and the operation can also be stopped for the cassette having a long unused period after once activated or until it is used next. Therefore, in the second example, an example in which the operation of the cassette having a long unused period is appropriately stopped will be described.

[Motor Control According to the Second Example]

First, motor control will be described with reference to FIG. 12. Here, it is assumed that the order of conveyance illustrated in FIG. 12 is determined by the secondary command information 21*b* generated by the host server 1 using the storage information 21*a* by the banknote handling apparatus 10.

Figure 12:
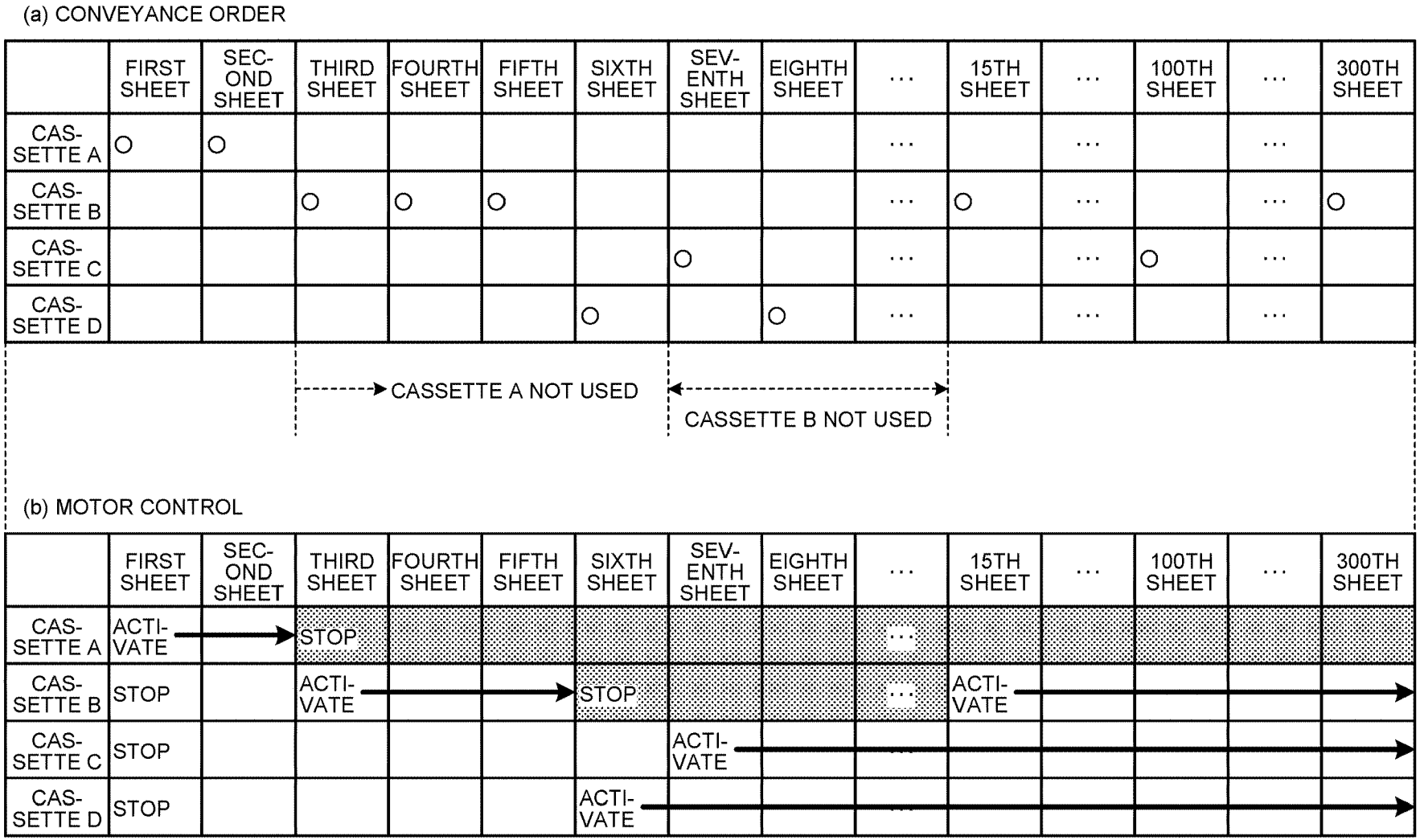
FIG. 12 is a diagram explaining motor control of each cassette according to a second example.

FIG. 12 is a diagram explaining motor control of each cassette according to the second example. (a) of FIG. 12 illustrates the order of the banknote conveyance destinations, and (b) of FIG. 12 illustrates motor control of each cassette. Here, as illustrated in (a) of FIG. 12, the cassette A 30 is activated for the first sheet, then used as the storage destination for the second sheet, but is not used for the third and subsequent sheets. After the cassette B 40 is used for the third to fifth sheets, the cassette B 40 is not used up to 15th sheet and is appropriately used for the 15th and subsequent sheets up to the 300th sheet. After the cassette C 50 is activated for the seventh sheet, the cassette C 50 is appropriately used up to the 300th sheet. After the cassette D 60 is used for the sixth and eighth sheets, the cassette D 60 is appropriately used up to the 300th sheet.

In this case, as illustrated in (b) of FIG. 12, the secondary processing unit 23 activates the motor 30*a* of the cassette A at the time of conveyance of the first sheet, and then stops the motor 30*a* since it is not used thereafter when the storage of the second sheet is completed.

In addition, the secondary processing unit 23 activates the motor 40*a* of the cassette B 40 at the time of conveyance of the third sheet, and determines whether or not the unused period (ten sheets) is equal to or more than a threshold value (for example, five sheets) since the timing of next use is the 15th sheet when the storage of the fifth sheet is completed. Here, since the unused period is equal to or more than the threshold value, the secondary processing unit 23 stops the motor 40*a*. Then, the secondary processing unit 23 reactivates the motor 40*a* of the cassette B 40 at the time of conveyance of the 15th sheet, then activates the motor 40*a* up to the end, and stops the motor 40*a* when the storage of the 300th sheet is completed.

In addition, the secondary processing unit 23 activates the motor 50*a* of the cassette C 50 at the time of conveyance of the seventh sheet, then activates the motor 50*a* up to the end, and stops the motor 50*a* when the storage of the 300th sheet is completed.

In addition, the secondary processing unit 23 activates the motor 50*a* of the cassette D 50 at the time of conveyance of the sixth sheet, and when storage is completed, determines whether or not the unused period (two sheets) is equal to or more than a threshold value (for example, five sheets) since the timing of next use is the eighth sheet. Here, since the unused period is less than the threshold value, the secondary processing unit 23 activates the motor 40*a* to the end without stopping the motor 40*a*, and stops the motor 40*a* after completion of the storage of the 300th sheet.

(Flow of the Secondary Deposit Processing)

Figure 13:
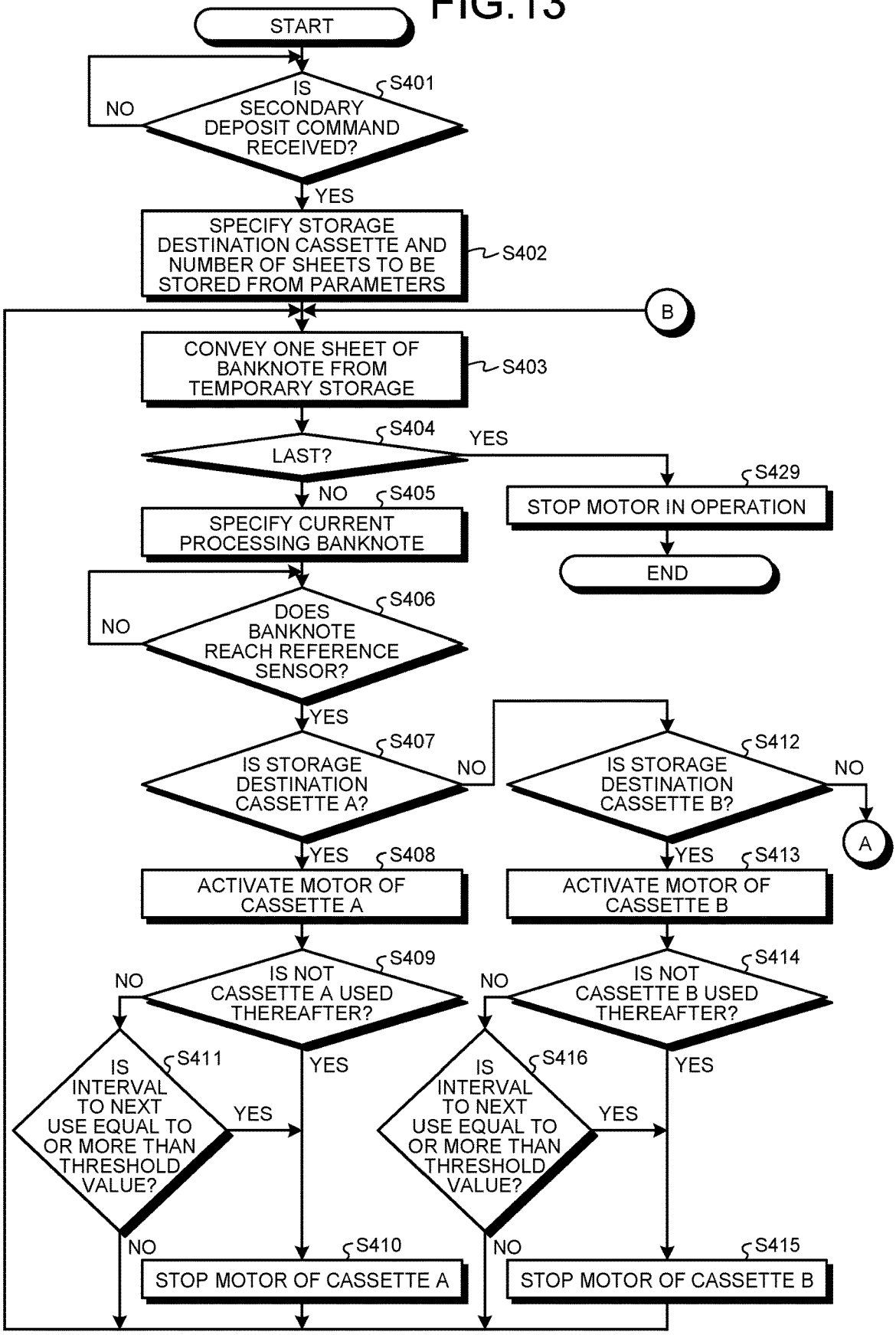
FIG. 13 is a flowchart illustrating a flow of secondary deposit processing of the banknote handling apparatus according to the second example.
Figure 14:
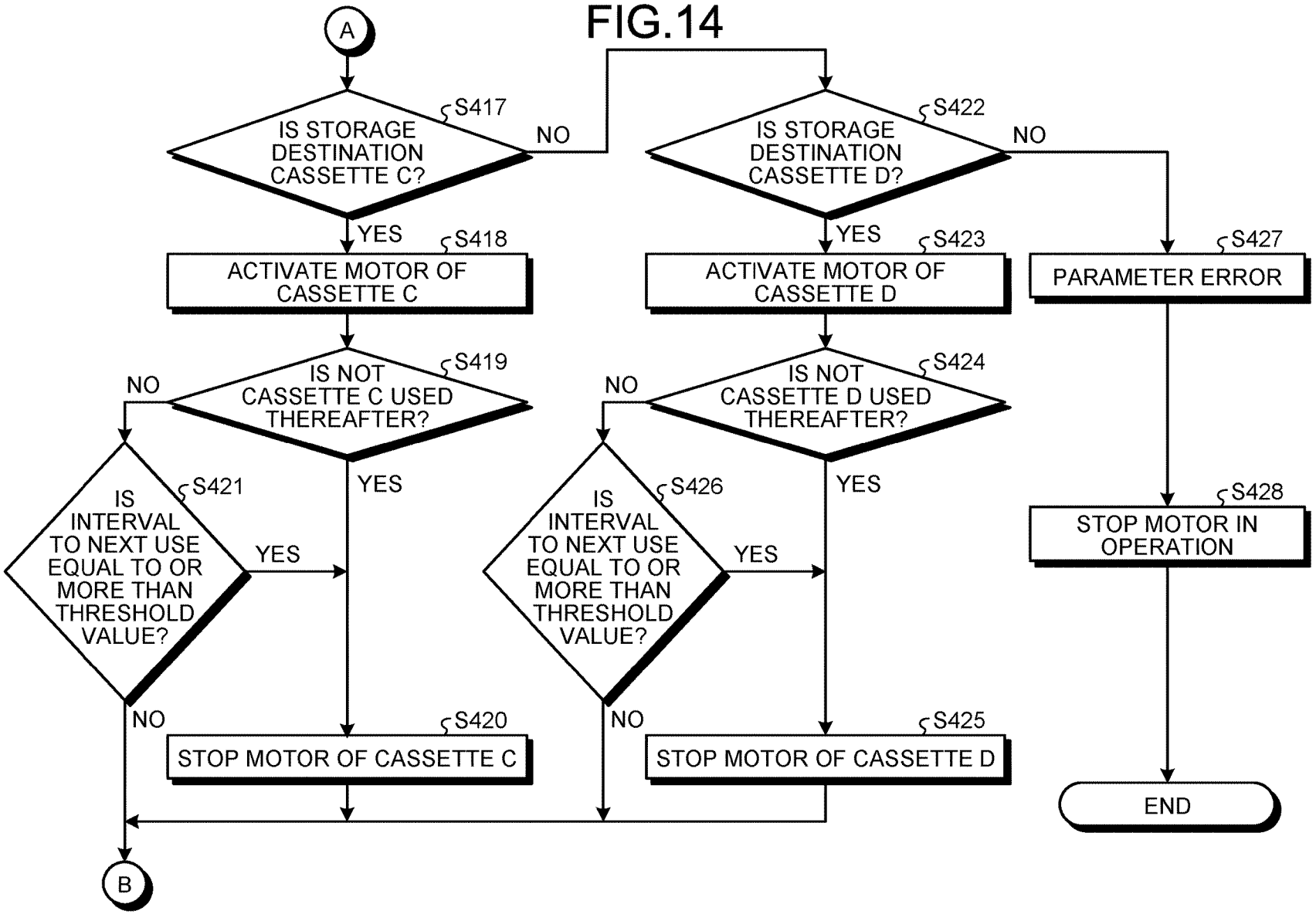
FIG. 14 is a flowchart illustrating a flow of secondary deposit processing of the banknote handling apparatus according to the second example.

Next, the secondary deposit processing according to the second example will be described. Note that the overall processing sequence and the primary deposit processing are similar to those of the first example, and thus detailed description thereof will be omitted. FIGS. 13 and 14 are flowcharts illustrating a flow of the secondary deposit processing of the banknote handling apparatus 10 according to the second example. As illustrated in FIG. 13, since S401 to S406 are the same processing as S301 to S306 described in FIG. 10 of the first example, detailed description thereof will be omitted.

Specifically, the secondary processing unit 23 refers to the secondary command information 21*b*, and in a case where the storage destination of the banknote to be conveyed is the cassette A 30 (S407: Yes), activates the motor 30*a* of the cassette A 30 (S408). Note that when the motor 30*a* is already activated, the processing of S408 is omitted. Then, when the secondary processing unit 23 determines that the cassette A 30 is not used as the storage destination thereafter (S409: Yes) according to the secondary command information 21*b*, the secondary processing unit 23 stops the motor 30*a* of the cassette A 30 (S410), and then executes S403 and the subsequent steps on the banknote in the next order of conveyance.

On the other hand, when the secondary processing unit 23 determines that the cassette A 30 is used as the storage destination thereafter (S409: No), the secondary processing unit 23 refers to the secondary command information 21*b* and determines whether or not the interval (unused period) until the next use is equal to or more than the threshold value (S411). Here, in a case where the unused period is equal to or more than the threshold value (S411: Yes), the secondary processing unit 23 temporarily stops the motor 30*a* of the cassette A 30 (S410), and then executes S403 and the subsequent steps on the banknote in the next order of conveyance. On the other hand, when the unused period is less than the threshold value (S411: No), the secondary processing unit 23 maintains the driving of the motor 30*a* of the cassette A 30 and executes S403 and the subsequent steps on the banknote in the next order of conveyance.

In addition, the secondary processing unit 23 refers to the secondary command information 21*b*, and in a case where the storage destination of the banknote to be conveyed is not the cassette A 30 (S407: No), but the cassette B 40 (S412: Yes), activates the motor 40*a* of the cassette B 40 (S413). Note that when the motor 40*a* is already activated, the processing of S413 is omitted. Then, when the secondary processing unit 23 determines that the cassette B 40 is not used as the storage destination thereafter (S414: Yes) according to the secondary command information 21*b*, the secondary processing unit 23 stops the motor 40*a* of the cassette B 40 (S415), and then executes S403 and the subsequent steps on the banknote in the next order of conveyance.

On the other hand, when the secondary processing unit 23 determines that the cassette B 40 is used as the storage destination thereafter (S414: No), the secondary processing unit 23 refers to the secondary command information 21*b* and determines whether or not the interval (unused period) until the next use is equal to or more than the threshold value (S416). Here, in a case where the unused period is equal to or more than the threshold value (S416: Yes), the secondary processing unit 23 temporarily stops the motor 40*a* of the cassette B 40 (S415), and then executes S403 and the subsequent steps on the banknote in the next order of conveyance. On the other hand, when the unused period is less than the threshold value (S416: No), the secondary processing unit 23 maintains the driving of the motor 40*a* of the cassette B 40 and executes S403 and the subsequent steps on the banknote in the next order of conveyance.

In addition, as illustrated in FIG. 14, the secondary processing unit 23 refers to the secondary command information 21*b*, and in a case where the storage destination of the banknote to be conveyed is not the cassette B 40 (S412: No), but the cassette C 50 (S417: Yes), activates the motor 50*a* of the cassette C 50 (S418). Note that when the motor 50*a* is already activated, the processing of S418 is omitted. Then, when the secondary processing unit 23 determines that the cassette C 50 is not used as the storage destination thereafter (S419: Yes) according to the secondary command information 21*b*, the secondary processing unit 23 stops the motor 50*a* of the cassette C 50 (S420), and then executes S403 and the subsequent steps on the banknote in the next order of conveyance.

On the other hand, when the secondary processing unit 23 determines that the cassette C 50 is used as the storage destination thereafter (S419: No), the secondary processing unit 23 refers to the secondary command information 21*b* and determines whether or not the interval (unused period) until the next use is equal to or more than the threshold value (S421). Here, in a case where the unused period is equal to or more than the threshold value (S421: Yes), the secondary processing unit 23 temporarily stops the motor 50*a* of the cassette C 50 (S420), and then executes S403 and the subsequent steps on the banknote in the next order of conveyance. On the other hand, when the unused period is less than the threshold value (S421: No), the secondary processing unit 23 maintains the driving of the motor 50*a* of the cassette C 50 and executes S403 and the subsequent steps on the banknote in the next order of conveyance.

In addition, the secondary processing unit 23 refers to the secondary command information 21*b*, and in a case where the storage destination of the banknote to be conveyed is not the cassette C 50 (S417: No), but the cassette D 60 (S422: Yes), activates the motor 60*a* of the cassette D 60 (S423). Note that when the motor 60*a* is already activated, the processing of S423 is omitted. Then, when the secondary processing unit 23 determines that the cassette D 60 is not used as the storage destination thereafter (S424: Yes) according to the secondary command information 21*b*, the secondary processing unit 23 stops the motor 60*a* of the cassette D 60 (S425), and then executes S403 and the subsequent steps on the banknote in the next order of conveyance.

On the other hand, when the secondary processing unit 23 determines that the cassette D 60 is used as the storage destination thereafter (S424: No), the secondary processing unit 23 refers to the secondary command information 21*b* and determines whether or not the interval (unused period) until the next use is equal to or more than the threshold value (S426). Here, in a case where the unused period is equal to or more than the threshold value (S426: Yes), the secondary processing unit 23 temporarily stops the motor 60*a* of the cassette D 60 (S425), and then executes S403 and the subsequent steps on the banknote in the next order of conveyance. On the other hand, when the unused period is less than the threshold value (S426: No), the secondary processing unit 23 maintains the driving of the motor 60*a* of the cassette D 60 and executes S403 and the subsequent steps on the banknote in the next order of conveyance.

On the other hand, when the storage destination is not the cassette D 60 (S422: No), all the cassettes do not correspond to the storage destination, and thus the secondary processing unit 23 determines that there is a parameter error (S427), stops all the motors in operation (S428), and ends the secondary deposit processing.

Note that, in S404 of FIG. 13, when there is no banknote to be conveyed (S404: Yes), the secondary processing unit 23 stops all the motors in operation (S429), and ends the secondary deposit processing.

Effects

As described above, the banknote handling apparatus 10 according to the second example can stop the operation of a cassette having a long unused period in addition to a cassette that is not scheduled to be used among the operated cassettes. Therefore, as compared with the first example, the cassette stop time is longer, and the power consumption can be reduced. In addition, the banknote handling apparatus 10 according to the second example can stop only a cassette having a long unused period among the operated cassettes. Even in this case, the cassette stop time is longer and the power consumption can be reduced as compared with the general technique.

Third Example

Although the examples of the present invention have been described, the present invention may be implemented in various different forms other than the above-described examples.

Numerical Value, Threshold Value, and the Like

In addition, the various numerical values, the threshold values, the number of cassettes, the banknote types, the number of banknotes, and the like used in the examples described above are merely examples, and can be arbitrarily changed. In addition, the threshold value described in the second example can be arbitrarily set, but for example, it is preferable to set the threshold value to be longer than the reference based on the time needed for the operation speed to the extent that the cassette can be activated and the banknote can be stored.

[Generation of the Secondary Command Information]

For example, in the examples described above, the example has been described in which the banknote handling apparatus 10 transmits the storage information 21*a* to the host server 1, determines the conveyance order according to the secondary command information 21*b* generated by the host server 1, and controls the motor of each cassette, but it is not limited thereto. For example, in a case where the control unit 20 of the banknote handling apparatus 10 can hold the cassette information 3*a*, the secondary command information 21*b* and the conveyance order can be generated by a method similar to the host server 1.

System

The processing procedure, the control procedure, the specific names, and the information including various data and parameters described in the document and the drawings described above can be arbitrarily changed unless otherwise specified. In addition, the specific examples, distributions, numerical values, and the like described in the examples are merely examples, and can be arbitrarily changed.

In addition, the components of each apparatus illustrated in the drawings are functionally conceptual, and are not necessarily physically configured as illustrated in the drawings. That is, specific forms of distribution and integration of the apparatuses are not limited to those illustrated in the drawings. That is, all or a part thereof can be functionally or physically distributed and integrated in an arbitrary unit according to various loads, use status, and the like. Furthermore, all or an arbitrary part of each processing function performed in each apparatus can be realized by a CPU and a program analyzed and executed by the CPU, or can be realized as hardware by wired logic.

According to the embodiments, wasteful power consumption can be suppressed.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A banknote handling apparatus comprising:

a distinguishing unit that distinguishes respective paper sheets input;

a first storage mechanism that temporarily stores the respective paper sheets distinguished;

a plurality of second storage mechanisms that are provided for each type of paper sheet and store the corresponding paper sheet;

a drive control unit that:

transmits first information to a host server, the first information being information of the respective paper sheets stored in the first storage mechanism, acquires second information from the host server, the second information being generated by the host server on a basis of the first information, and being information in which (a) a conveyance order of conveying the respective paper sheets from the first storage mechanism to any of the second storage mechanisms, (b) a paper sheet to be conveyed and (c) a conveyance destination second storage mechanism of the plurality of second storage mechanisms are associated; and controls activation and stop of each of the plurality of second storage mechanisms to store the respective paper sheets in the corresponding second storage mechanism on a basis of the second information.

2. The banknote handling apparatus according to claim 1, wherein the drive control unit activates a drive apparatus of a second storage mechanism specified as a conveyance destination according to the conveyance order when conveying the respective paper sheets from the first storage mechanism to the corresponding second storage mechanism in a state where the respective drive apparatuses are stopped, determines whether or not the second storage mechanism that has started operation is to be used as a conveyance destination even after start of operation with reference to the conveyance order, and controls the drive apparatus of the second storage mechanism that has started operation on a basis of a result of determination.

3. The banknote handling apparatus according to claim 2, wherein the drive control unit stops the drive apparatus of the second storage mechanism when it is determined on the basis of the result of determination that the second storage mechanism that has started operation is not used as a conveyance destination after start of the operation.

4. The banknote handling apparatus according to claim 2, wherein the drive control unit stops the drive apparatus of the second storage mechanism when it is determined on the basis of the result of determination that the second storage mechanism that has started operation is not used as a conveyance destination for a predetermined period after start of the operation.

5. A banknote storage method comprising:

distinguishing respective paper sheets input;

conveying the respective paper sheets to a first storage mechanism for temporary storage;

transmitting first information to a host server, the first information being information of the respective paper sheets stored in the first storage mechanism, acquiring second information from the host server, the second information being generated by the host server on a basis of the first information, and being information in which (a) a conveyance order of conveying the respective paper sheets from the first storage mechanism to any of a plurality of second storage mechanisms that are provided for each type of paper sheet and store the corresponding paper sheet, (b) a paper sheet to be conveyed and (c) a conveyance destination second storage mechanism of the plurality of second storage mechanisms are associated; and controlling activation and stop of each of the plurality of second storage mechanisms to store the respective paper sheets in the corresponding second storage mechanism on a basis of the second information.

6. A non-transitory computer-readable recording medium having stored therein a banknote storage program that causes a computer to execute a process comprising:

distinguishing respective paper sheets input;

conveying the respective paper sheets to a first storage mechanism for temporary storage;

transmitting first information to a host server, the first information being information of the respective paper sheets stored in the first storage mechanism, acquiring second information from the host server, the second information being generated by the host server on a basis of the first information, and being information in which (a) a conveyance order of conveying the respective paper sheets from the first storage mechanism to any of a plurality of second storage mechanisms that are provided for each type of paper sheet and store the corresponding paper sheet, (b) a paper sheet to be conveyed and (c) a conveyance destination second storage mechanism of the plurality of second storage mechanisms are associated; and controlling activation and stop of each of the plurality of second storage mechanisms to store the respective paper sheets in the corresponding second storage mechanism on a basis of the second information.

* * * * *